US007223095B1

(12) United States Patent
Corry

(10) Patent No.: US 7,223,095 B1
(45) Date of Patent: May 29, 2007

(54) COMPOSITE CONCRETE ARTIFICIAL LOG

(76) Inventor: Arthur Andrew Corry, 6832 Trail Blvd., Naples, FL (US) 34108

( * ) Notice: Subject to any disclaimer, the term of this patent is extended or adjusted under 35 U.S.C. 154(b) by 0 days.

(21) Appl. No.: 11/363,443

(22) Filed: Feb. 27, 2006

(51) Int. Cl.
*F24C 3/04* (2006.01)

(52) U.S. Cl. ..... 431/125; 126/512; 126/92 R

(58) Field of Classification Search ..... 431/125, 431/126; 126/512, 552, 500
See application file for complete search history.

(56) References Cited

U.S. PATENT DOCUMENTS 5,069,200 A * 12/1991 Thow et al. ..... 126/512
5,118,539 A * 6/1992 Sebby et al. ..... 428/15
5,284,686 A * 2/1994 Thow ..... 428/15
6,260,548 B1 * 7/2001 Wade ..... 126/512
7,074,035 B2 * 7/2006 Lyons et al. ..... 431/125

* cited by examiner

*Primary Examiner*—Kenneth Rinehart
*Assistant Examiner*—Chuka C Ndubizu

(57) ABSTRACT

A method of improving an individual artificial concrete log widely used in gas fires, the new concrete log(1) having at least one decorative ceramic fiber pad (1*a*) or (2*a*) secured in the cut out(2) section, the pad (1*a* or 2*a*) is positioned to mate with the contour of the concrete log (1). The decorative pad (1*a* or 2*a*) is installed to provide a secondary air chamber(3) between the back of the decorative pad (1*a* or 2*a*) and inner surface of the cut out (2). When the log is placed on an existing gas fire some of the gas flames are directed up through the secondary air chamber(3) creating flames coming out of the body of the composite concrete log(1) at the same time gas flames impinge the front decorative surface(6) of the installed ceramic fiber pad (1*a* or 2*a*) producing a radiant surface (6) simulating a real burning log thereby improving the overall visual effect of most existing gas log fire.

2 Claims, 3 Drawing Sheets

COMPOSITE CONCRETE ARTIFICIAL LOG

FIELD OF INVENTION

The present invention relates generally to simulated cast concrete logs and, more particular, to a simulated composite cast concrete logs used in vented gas log fires and vent free gas log fires and the like.

BACKGROUND OF THE INVENTION

Gas log fires using concrete logs are popular in North America due to the convenience of no refueling or cleaning out ashes. Most manufactured artificial concrete logs are cast in flexible molds of the first model and whilst the formulation may vary from manufacturer to manufacture the basic raw material is a high temperature cement a aggregate filler, a wetting agent and tap water added to form the desired concrete mix, after removal from the mold the concrete artificial log is colored to resemble a real log.

The widely used cast concrete artificial logs result in excellent mirror image detail reproduction and provide almost a perfect copy of none burning real logs but when used in a gas log fire the concrete logs lacks any glowing surfaces, radiant heat output or directional flame technology when compared to real burning log fire or the widely used vacuum formed ceramic fiber artificial log taught in the Corry U.S. Pat. No. 5,700,409 and the Corry U.S. Pat. No. 6,139,786.

Therefore there is a serious demand in the market place for a retrofit individual composite artificial log combining the remarkable detailed reproduction of the cast concrete log and radiant heat output and glowing properties of inorganic ceramic fiber and the introduction of new flame directional technology when used in a gas fire and, in which this innovative and novel composite log will be viable to manufacture, my invention described herein will meet all these requirements.

In U.S. Pat. No. 5,026,597 Thow teaches a concrete cast composite log for use in a gas log fire having two complete halves a complete upper half of concrete that simulates a real log bark finish and a lower plain half consisting of a vacuum formed plain surface block of ceramic fiber, the two halves are secured together length ways forming a closed sand-which the top half represents the simulated real log bark finish and the lower half is a plain surface and does not continue the decorative simulated real log bark finish of the concrete log body, it is true that up to now the Thow U.S. Pat. No. 5,026,597 invention never achieved any success in the gas log fire market place.

SUMMARY OF THE INVENTION

The present invention is directed to a individual composite artificial log which has a main body cast of a high temperature cement wet mix with an aggregate added and at least one inorganic ceramic fiber vacuum formed decorative pad that simulates the outer log surface, the inorganic ceramic fiber pad is secured firmly into the at least one cut out provided in the body of the concrete log, the inorganic ceramic fiber decorative pad is so positioned at the point of contact with the gas burner flames causing impingement which creates an instant glowing radiant surface.

Where the at least one inorganic ceramic fiber decorative pad is secured firmly in the concrete log cut out in order to provide a secondary air chamber the inorganic ceramic fiber decorative pad is so positioned at the point of contact with the gas burner flames whereby some of the gas burner flames pass upwards through the at least one secondary air chamber in between the concrete log body and the inorganic ceramic fiber decorative pad creating a visual effect of flames coming out of the composite log body at the same time some of the gas burner flame impinge the front surface of the inorganic ceramic fiber decorative pad creating a radiant and glowing visual effect which provides a greatly improved simulation of a real burning log as well as increased radiant heat output.

The manufacture of cast concrete log is well known the material used is supplied by Fondu La Farge Seca R51 with a volcanic added aggregate wet mix.

The raw material slurry mix used to vacuum form the decorative pads is oil free ceramic fiber supplied by the America Premier Refractory Corporation mixed with colloidal silicate as supplied by Nalfloc Industries, the fixing agent used to hold the decorative ceramic fiber pad securely to the concrete log body is a high temperature ceramic fiber cement supplied by American Premier Refractory Corporation, the composite log visual appearance is further enhanced by the use of high temperature coloring to resemble outer wood and inner wood and bark finish such colors are available from Bayer Chemical Corporation and American Minerals Corporation. These and other features improvements and advantages of the present invention will be more apparent with reference to the accompanying drawings and the detailed description thereof.

BRIEF DESCRIPTION OF DRAWINGS

For better understanding of the present invention, and to show more clearly how it may be carried into effect, reference will now be made, by way of example to the accompanying drawings. The drawing show preferred embodiments of the present invention, in which:

FIG. 1*a* Top view of composite log fitted with ceramic fiber pad with vertical shoulders showing ceramic line FIG. 2 Ceramic fiber vacuum formed decorative pad with flat back provides secondary air chamber.

DETAILED DESCRIPTION OF THE PREFERRED EMBODIMENT

Figure 1:
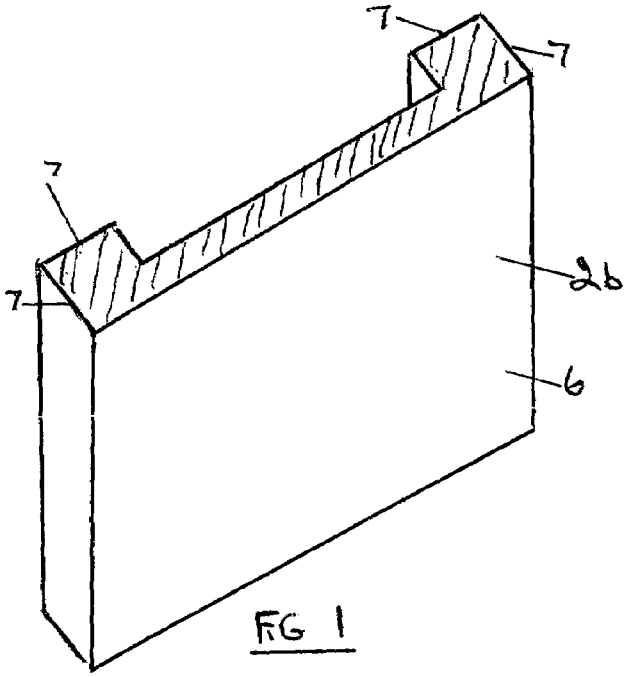
FIG. 1 Ceramic fiber vacuum formed decorative pad with vertical contact shoulders provides a secondary air chamber.
Figure 1A:
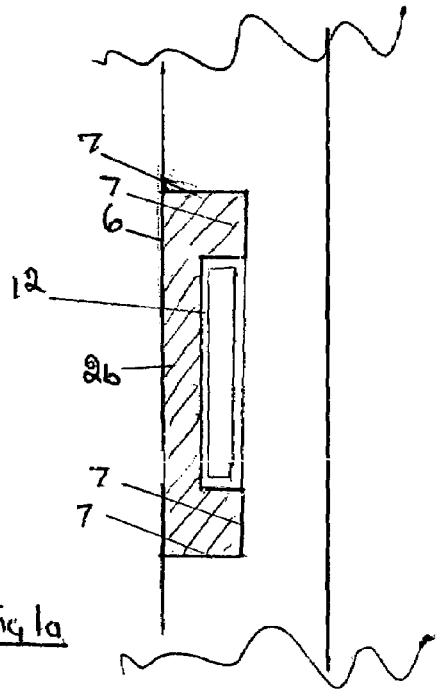
Figure 2:
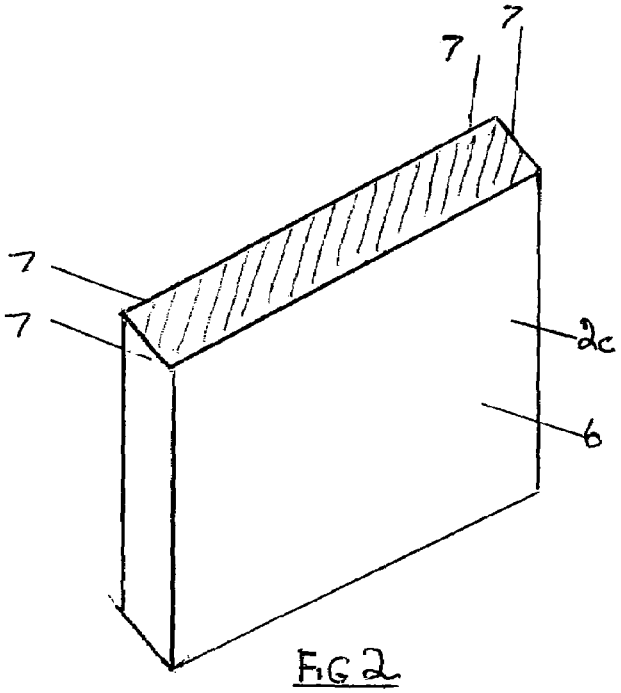
FIG. 2*a*. Top view of composite log fitted with flat back ceramic fiber pad showing ceramic liner.
Figure 2A:
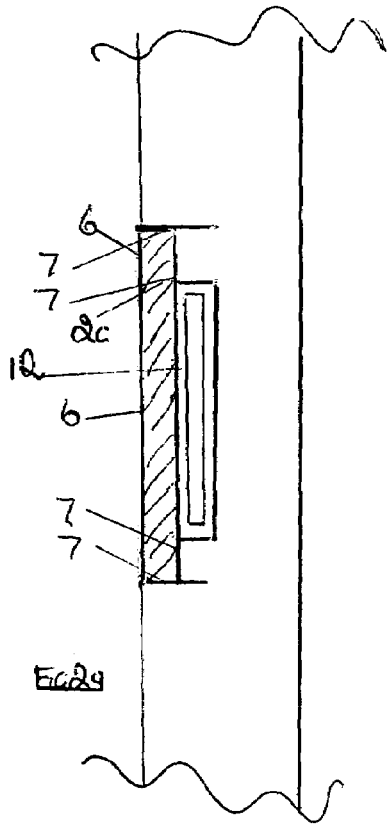
Figure 3:
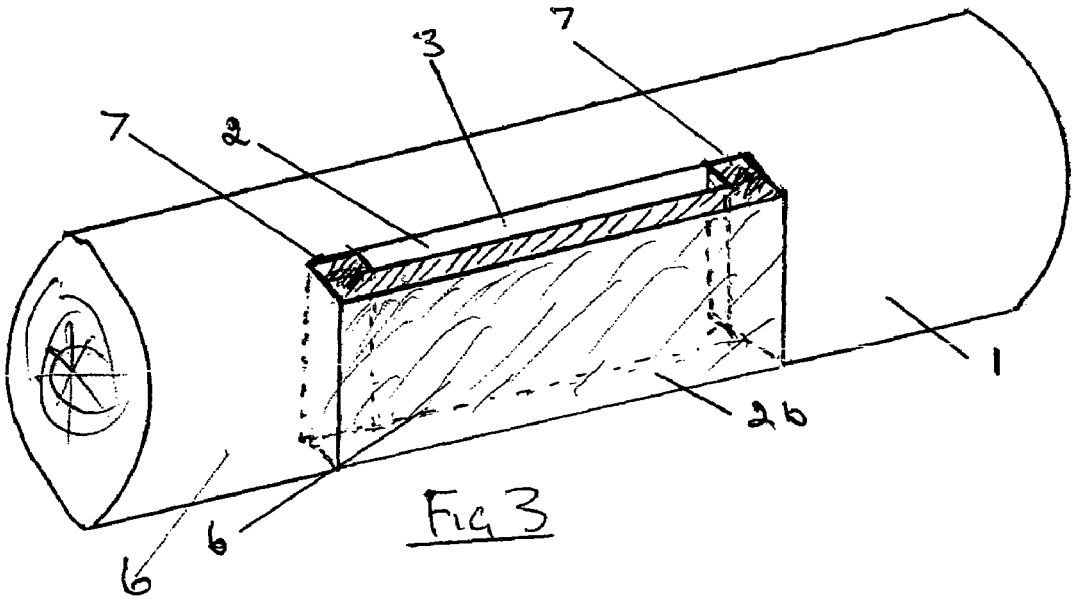
FIG. 3. Composite concrete log fitted with ceramic fiber pad having vertical shoulders shows secondary air chamber FIG. 4. Concrete log shows plain sided cut out.
Figure 6:
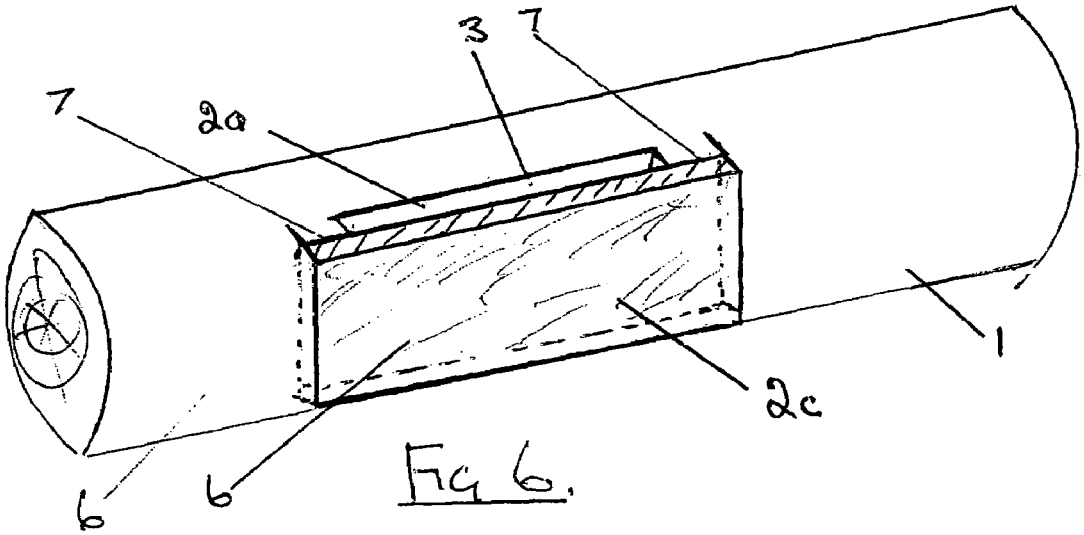
FIG. 6. Composite concrete log fitted with a flat back ceramic fiber pad in the convoluted cut out provides a secondary air chamber.
Figure 4:
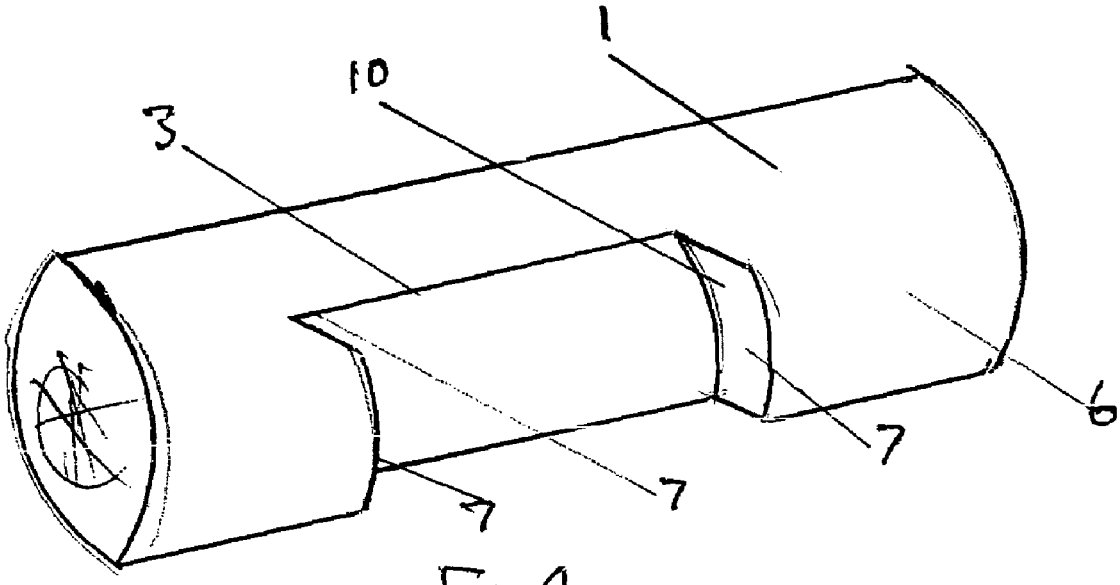
Figure 5:
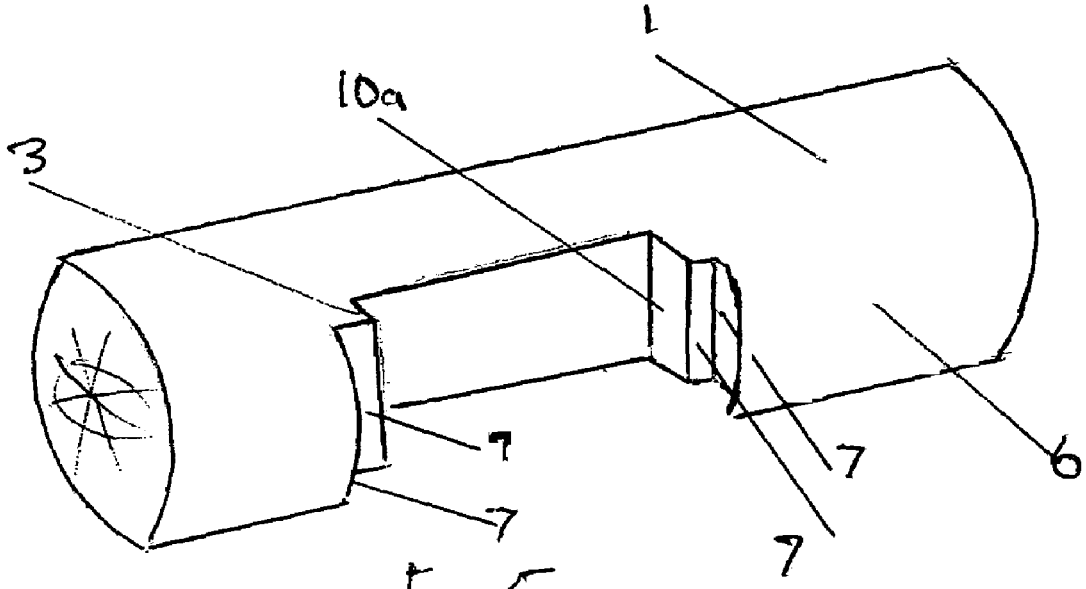
FIG. 5. Concrete log with convoluted cut out provides secondary air chamber.

For purpose of describing the preferred embodiment, the terminology used in reference to the numbered components in the drawings is as follows:

1. Concrete Log.
2. Concrete Log Cut-Out.
2*a*. Concrete Log Convoluted Cut-Out.
2*b*. Ceramic Fiber Pad with Vertical Shoulders.
2*c*. Ceramic Fiber Pad with flat back.
3. Secondary Air Chamber.
6. Decorative Bark Finish.
7. Contact Surface.
10. Concrete Log Cut Out Flat sides.

10*a*. Concrete Log Cut Out Convoluted.

12. Thin walled sleeve liner.

An artificial concrete log(1) is cast the body shape includes at least one cut out (2) or (2*a*) in order to form at least one open cavity the open cavity will provide a secondary air chamber (3), the log (1) is placed on an existing gas log fire for some of the gas flames to travel up producing an inner log burning visual effect at the same time the gas flames will impinge on the front surface of the ceramic fiber pad (6) producing a surface glow (6) and radiant heat simulates a real burning log with flames coming out of the body of the log when used in a gas log fire.

In testing it was found the most desired visual effect is when the secondary air chamber opening is not less than 12 millimeters deep and 12 millimeters wide the height of the chamber is determined by the diameter of the composite log.

The inorganic ceramic fiber simulated vacuum formed outer surface pad (2*a*) (2*b*) is secured in the concrete log cut out and the ceramic fiber pad is contoured to mate with the contour of the concrete log using ceramic fiber cement which is commercially available from American Premier Refractory Corporation.

The secondary air chamber(3) may have a high temperature thin wall sleeve(12) such as ceramic or any other high temperature material when higher than normal operating temperatures are required.

The inorganic ceramic fiber decorative simulated outer log vacuum formed pads are best manufactured using my unique vacuum forming mold process Corry U.S. Pat. No. 6,139,786 and my unique vacuum flexible mold method Corry U.S. Pat. No. 5,700,409.

The composite log is colored to simulate a real log using High temperature color such as Bayers Black 303t or American Minerals Iron Chromite the main body color can be applied by dipping, spraying or brushing and the high lite finish is applied by a light brushing, color drying can be in a box or conveyor oven temperature of not less than 20 F.

Although the invention has been described in connection with the specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

I claim:

1. A individual artificial composite log for use in vented and vent free gas log fire comprising:

a individual artificial gas log made of high temperature cement and a filler aggregate wet mix cast in a flexible mold to simulated a real log having at least one cut out in the log body where an inorganic ceramic fiber vacuum formed decorative pad which simulates the outer appearance of a real log is secured firmly inside the cut out;

a high temperature thin walled sleeve lining;

wherein a high temperature cement is used to secure the inorganic ceramic fiber vacuum formed pad to the concrete log;

wherein a high temperature thin walled sleeve lining may be installed;

wherein at least one high temperature coloring agent is used to simulate the outer and inner wood color of a real log;

wherein at least one cut out section provides at least one secondary air chamber, wherein the at least one secondary air chamber is at least 12 millimeters deep and at least 12 millimeters wide and the height of the secondary air chamber will be determined by the overall (size) diameter of the girth of the composite concrete log.

2. A individual composite concrete log as set forth in claim 1 in which the artificial concrete log is fitted with at least one inorganic ceramic fiber vacuum formed decorative pad which is secured in the main body cut out simulates an outer log surface and whereas the back surface of the inorganic ceramic fiber vacuum formed pad provides sufficient contact surface in the main body of the concrete log cut out to provide at least one vertical secondary air chamber having an open entry at the bottom of the concrete log and an open exit at the top of the concrete log.

* * * * *